US005699783A

United States Patent [19]

Kubo

[11] Patent Number: 5,699,783

[45] Date of Patent: Dec. 23, 1997

[54] WIRE SAWING METHOD OF REINFORCED CONCRETE STRUCTURE AND GUIDE PULLEY APPARATUS

[75] Inventor: Setsuo Kubo, Kyoto, Japan

[73] Assignee: Kabushiki Kaisha Dymosha, Kyoto, Japan

[21] Appl. No.: 751,475

[22] Filed: Nov. 18, 1996

Related U.S. Application Data

[63] Continuation of Ser. No. 360,570, Dec. 21, 1994, abandoned.

[30] Foreign Application Priority Data

Dec. 30, 1993 [JP] Japan ..... 5-074866
Feb. 9, 1994 [JP] Japan ..... 6-035163

[51] Int. Cl.[6] ..... B28D 1/08

[52] U.S. Cl. ..... 125/21; 457/168; 457/296; 457/311

[58] Field of Search ..... 125/21; 457/168, 457/296, 321; 83/611

[56] References Cited

U.S. PATENT DOCUMENTS 2,577,545 12/1951 Stratton .
4,735,188 4/1988 Kubo ..... 125/21
4,765,307 8/1988 Kubo .
5,060,628 10/1991 Ishida .

FOREIGN PATENT DOCUMENTS 3175006 7/1991 Japan ..... 125/21

*Primary Examiner*—Robert A. Rose
*Assistant Examiner*—George Nguyen
*Attorney, Agent, or Firm*—Armstrong, Westerman, Hattori, McLeland & Naughton

[57] ABSTRACT

A wire method of a reinforced concrete structure, and a guide pulley apparatus for the method, wherein a cutting wire 18 guided by a pair of guide pulleys 7a, 7b disposed on the same plane as a scheduled cutting surface of a reinforced concrete structure 2 is caused to endlessly circulate and travel along the surface of the reinforced concrete structure under a regulated tension and at a regulated travelling speed through an auxiliary guide pulley 8c for separating one portion of the cutting wire from the other portion thereof.

20 Claims, 5 Drawing Sheets

WIRE SAWING METHOD OF REINFORCED CONCRETE STRUCTURE AND GUIDE PULLEY APPARATUS

This application is a continuation of application Ser. No. 08/360,570 filed Dec. 21, 1994, now abandoned.

BACKGROUND OF THE INVENTION

1. Field of the Invention

This invention relates to a wire sawing method of concrete structures such as buildings, bridges, foundation blocks, etc, for cutting and disintegrating them by wire sawing, and a guide pulley apparatus.

2. Description of the Prior Art

Disc blade type cutting machines have been widely used in the past for the partial disintegration of reinforced concrete structures by cutting. However, such cutting machines have a small size and a light weight for reasons of blade production, working factors and easy handling, and therefore have low cutting capacity. Accordingly, a cutting sectional area is limited to a narrow range, and a maximum cutting depth is about 30 to 40 cm. The partial disintegration by the rotation of the disc blade involves the problems that unnecessary portions, too, must be over-cut.

As a method of solving altogether the problems described above, the inventor of the present invention has recently developed a method which cuts and disintegrates a reinforced concrete structure by wire sawing. This method winds cutting wire obtained by providing a wire rope with a cutting property on a reinforced concrete structure, and causes the cutting wire to circulate and travel endlessly by a wire driving device at a regulated travelling speed and with a regulated tension.

In this case, the cutting wire generally employs the structure wherein beads having a diamond abrasive grain layer are disposed at a suitable pitch on a wire rope through, or without, a spacer such as a coil spring. The wire driving device includes driving pulleys on which the cutting wire are wound, a prime mover for rotating the driving pulleys such as a hydraulic motor or an induction motor, and other accessorial mechanisms. The wire driving device is allowed to move along a track, more definitely, had driving wheels which move on a rail, or is driven on a rack by driving pinions.

In wire sawing of the reinforced concrete structure, the cutting wire is bent relatively gently from the initial stage to the intermediate stage of cutting. In other words, the cutting wire smoothly travels with a large radius of curvature, and cuts not only the concrete layer which comes into contact therewith but also reinforcing bars. When cutting reaches the final stage and the diameter and the sectional area of the uncut portion become smaller, however, the cutting wire is sharply bent at the contact portion with the uncut portion and travels. Accordingly, metal fatigue of the wire rope in the cutting wire progresses, and the beads and the spacer which cannot be bent along with the wire rope, are particularly caught by the reinforcing bars. Consequently, the problems occur in that they impede the travel of the cutting wire, an abnormal load is applied to the wire rope, and breakage of the wire rope and the spacer is likely to occur. If breakage of the wire rope for the cutting wire occurs during wire sawing of the reinforced concrete structure, productivity remarkably drops because the broken portion must be repaired and connected again, or must be replaced by a new cutting wire, and the wire sawing operation must be suspended to remount the cutting wire. Further, the broken cutting wire jumps off from the concrete structure and invites an unexpected danger.

Even when such a break accident does not occur during wire sewing, the cutting wire is likely to lump off from the reinforced concrete structure simultaneously with the end of cutting, and endangers the surroundings.

To cope with this problem, the Applicant of the present invention has previously proposed the structure wherein a pair of guide pulleys are disposed on the same plane as a scheduled cutting surface of a reinforced concrete structure as a matter to be cut, and the cutting wire are wound from outside the guide pulleys (Japanese Patent Publication No. 10956/1962). In the proposal described above, a suitable auxiliary pulley is also disposed besides the pair of guide pulleys so that the cutting wire can smoothly travel from the matter to be cut to the driving device.

SUMMARY OF THE INVENTION

In the wire sawing method of the reinforced concrete structure described above, various guide pulleys are used for smooth travel of the cutting wire. In this case, the travel of the cutting wire is changed from the travel inside a horizontal plane to the travel inside a vertical plane, or vice versa, by combining horizontal pulleys with vertical pulleys and furthermore, the travelling direction of the cutting wire can be changed from an arbitrary plane to a plane orthogonal to the former by disposing these combined pulleys under an appropriate tilted state.

When the cutting wire are allowed to travel by disposing a pair of combined pulleys comprising such horizontal and vertical pulleys, the two, going and returning, cutting wire must be unavoidably brought close to each other due to the limitation of the installation space of the driving device. In such a case, the two cutting wire having mutually different travelling directions cannot keep complete parallelism during their travel. Particularly because the cutting wire travelling from the driving device toward the matter to be cut exists on the loosening side, this cutting wire sometimes travels under a slacked state. In such a case, the two cutting wire travelling at a high speed in the mutually different travelling directions come into mutual contact, so that the diamond beads suitably fixed to the cutting wire collide against one another and are broken, and in an extreme case, the cutting wire themselves are cut off.

Accordingly, the present invention aims at providing a wire sawing method of a reinforced concrete structure which prevents mutual contact, and eventual breakage, of the cutting wire which travel while being guided by respective guide pulleys, when the cutting wire for wire sawing are guided by a pair of guide pulleys.

To accomplish the object described above, the present invention provides a wire sawing method of a reinforced concrete structure characterized in that cutting wire guided by a pair of guide pulleys disposed on the same plane as a scheduled cutting surface of a reinforced concrete structure are caused to circulate and travel endlessly along the surface of the reinforced concrete structure under a regulated tension and at a regulated travelling speed through an auxiliary guide pulley for separating the cutting blades from each other; and a guide pulley apparatus for wire sawing characterized in that an auxiliary guide pulley is so disposed as to separate cutting wire guided by a pair of the guide pulleys from each other, in a wire sawing apparatus wherein the pair of oxide pulleys are disposed on the same plane as a scheduled cutting surface of a reinforced concrete structure along the surface of the reinforced concrete structure and the cutting wire are wound on the reinforcer concrete structure from outside at least one of the guide pulleys and are caused to circulate and travel endlessly under a regulated tension and at a regulated travelling speed.

Since the present invention employs the method described above, the reinforced concrete structure is cut when the cutting wire wound on it circulate and travel. In this instance, the travelling cutting wire are guided by a pair of guide pulleys, and while being guided by these guide pulleys, the cutting wire are separated from each other and prevented from mutual contact by the auxiliary guide pulley.

BRIEF DESCRIPTION OF THE DRAWINGS

FIG. 5(*b*) is a side view of FIG. 5(*a*);

FIG. 9(*b*) is a side view of FIG. 9(*a*).

DESCRIPTION OF THE PREFERRED EMBODIMENTS

Figure 1:
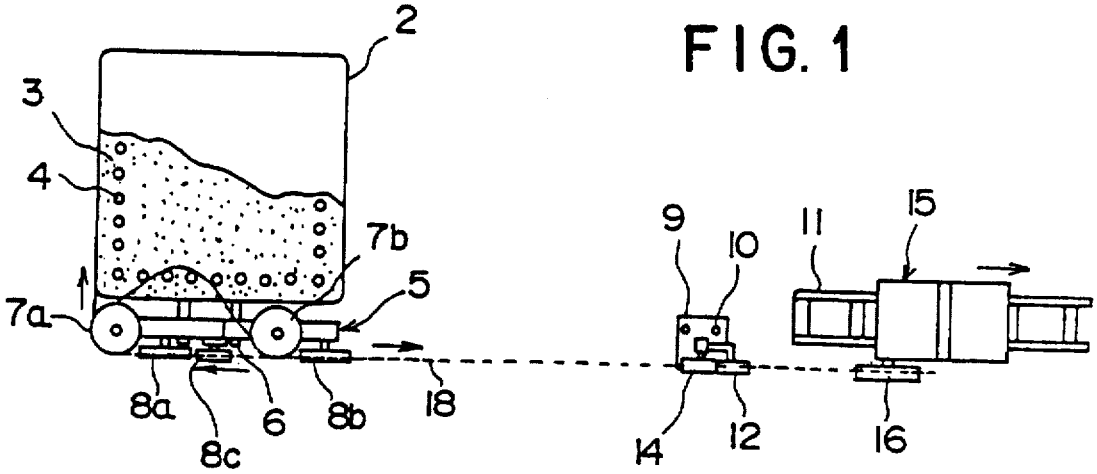
FIG. 1 is a plan view of an embodiment of the present invention.
Figure 2:
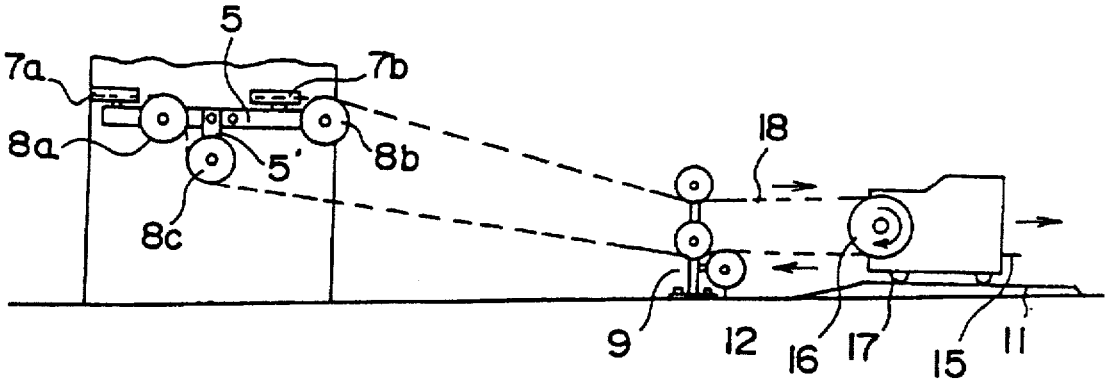
FIG. 2 is a side view of FIG. 1.
Figure 3:
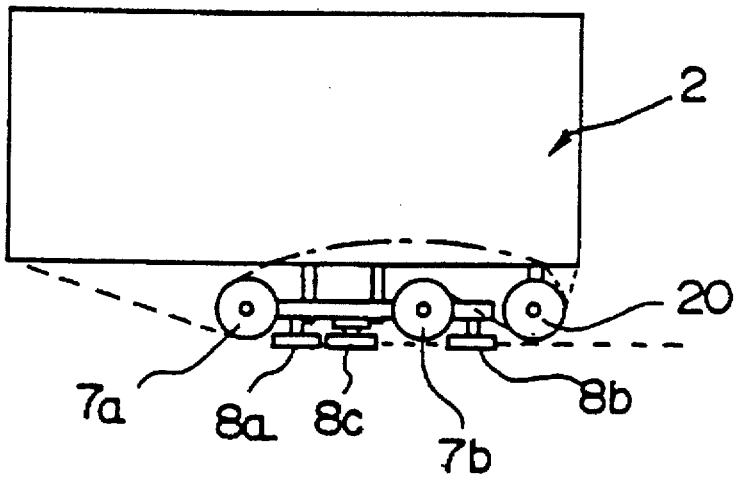
FIG. 3 is a plane view of another embodiment of the present invention.

An embodiment of the present invention will be explained with reference to the drawings. As shown in FIGS. 1 and 2, a reinforced concrete structure 2 having a shape of a square pole, which is a member to be cut, is placed on the road surface 1. The reinforced concrete structure 2 includes reinforcing bars 4 disposed in a vertical direction inside a concrete layer 3. A first guide pulley bed 5 is fixed by anchors 6 to the surface of the reinforced concrete structure 2. A pair of first main guide pulleys 7*a*, 7*b* disposed in a horizontal direction and a pair of second main guide pulleys 8*a*, 8*b* having a common tangent passing through pulley grooves and disposed in a vertical direction adjacent to the first main guide pulleys 7*a*, 7*b* are supported rotatably by the first guide pulley bed 5.

An auxiliary pulley bed 5' is so disposed between the second main guide pulleys 8*a* and 8*b* of the first guide pulley bed 5 as to protrude downward, and an auxiliary guide pulley 8*c* is rotatably supported by the auxiliary guide pulley bed 5'. As will be described later, this auxiliary guide pulley 8*c* is disposed in such a fashion that when one of two cutting wires extending from the second main guide pulleys 8*a*, 8*b* toward a wire driving device is wound on the auxiliary guide pulley 8*c*, the cutting wire are separated from each other.

It would be more convenient for handling and installation if these first main guide pulleys 7*a*, 7*b* and second main guide pulleys 8*a*, 8*b* are integrated by the first guide pulley bed 5 as described above, but they may be disposed individually and may be disposed on a fixed matter other than the reinforced concrete structure 2, such as on the road surface 1.

A second guide pulley bed 9 is fixed by anchors 10 on the road surface 1 with a certain distance from the reinforced concrete structure 2, and a rail 11 is disposed adjacent to the second guide pulley bed 9. Guide pulleys 12, 13 on a loosening side and a guide pulley 14 on a tension side that are disposed vertically are rotatably supported by the second guide pulley bed 9, and the wire driving device 15 is disposed movably on the rail 11. The wire driving device 15 includes a wire driving pulley 16 and its driving mechanism (not shown) as well as a driving wheel 17 meshing with the rail 11 and its driving mechanism (not shown).

The cutting wire 18 is wound on the wire driving pulley 16, extends from its loosening side, passes through one 8*a* of the second main guide pulleys through the oxide pulleys 12, 13 on the loosening side and is wound on the reinforced concrete structure 2 from outside the first main guide pulley 7*a* adjacent to the guide pulley 8*a* as represented by dash line in the drawing. Further, the cutting wire 18 passes inside the other 7*b* of the first main guide pulleys, is led out from the second main guide pulley 8*b* adjacent to the former, and returns to the wire driving pulley 16 through the guide pulley 14 on the tension side, in the endless arrangement.

When a predetermined zone of the reinforced concrete structure 2 must be cut when partially cutting the structure or forming an open portion, the cutting wire 18 may be passed through one or two hole portions (not shown) so bored as to penetrate through the reinforced concrete structure 2 instead of winding the cutting wire 18 on the entire periphery of the reinforced concrete structure 2.

In the construction described above, when the wire driving device 15 is operated and so actuated as to be capable of moving along the rail 11 in the right-hand direction in the drawing to rotate and drive the wire driving pulley 16, the cutting wire 18 circulatingly travels under a predetermined tension, and the reinforced concrete which comes into frictional contact with the cutting wire 18 is gradually cut from its surface into its inside.

In the case of horizontal cutting described above, the first main guide pulleys 7*a*, 7*b* are disposed in the horizontal direction and this also holds true of the cases of inclined cutting and vertical cutting, and they are disposed on the same plane as a scheduled cutting plane. Further, the angle of disposition of the second main guide pulleys 8*a*, 8*b* with respect to the first main guide pulleys 7*a*, 7*b* is at right angles in the case described above, but other angles may also be employed depending on the mode of disposition of the cutting wire 18 to the wire driving pulley 16. The second main guide pulleys 8*a*, 8*b* corresponding to the first main guide pulleys 7*a*, 7*b* share the tangent passing through the pulley groove. Accordingly, the cutting wire 18 can smoothly bridle and travel along the tangent between the first main guide pulleys 7*a*, 7*b* for cutting and the second guide pulleys 8*a*, 8*b* corresponding to the former.

The second main guide pulleys 8*a*, 8*b*, the guide pulleys 12, 13 on the loosening side and the guide pulley on the tension side are helpful to smoothly guide the endless cutting wire 18 wound on the upper cut portion of the reinforced concrete structure 2 to the wire driving pulley 16 of the wire driving device 15 on the road surface 1 in such manner as to be wire of travelling. Accordingly, these members may not be necessary depending on the positional relationship between the put portion and the wire driving pulley 16. Alternatively, the guide pulleys having a different mode of construction are disposed on the road surface 1, the reinforced concrete structure 2, the wire driving device 15 or others. For instance, when the cut portion exists below the wire driving device such as when the root portion of the reinforced concrete structure 2 in water is cut by the wire driving device 15 installed on the ground by wire sawing, it is possible to dispose the second main pulleys 8*a*, 8*b* above the first main guide pulleys 7*a*, 7*b* and to guide up ward the cutting wire 18.

As cutting proceeds, the contact portion of the cutting wire 18 with the reinforced concrete structure 2 travels while being curved, and this curved portion gradually moves towards the first main guide pulleys 7*a*, 7*b*. As described already, since the cutting wire 18 is disposed in such a manner as to extend from outside one of the main guide pulley 7*a* to the inside of the other of the first main guide pulley 7*b* through the reinforced concrete structure 2, the gap of the cutting wire 18 wound on the uncut portion of the reinforced concrete structure 2 between the tension side and the loosening side does not become smaller than the gap between the outside of one of the first main guide pulleys 7*a* and the inside of the other of the first main guide pulleys 7*b* even at the final stage of cutting. Accordingly, the curved portion of the cutting wire 18 at the contact portion does not become extremely small and sharp or is not bent as represented by one-dot-chain line in the drawing, and breakage of the cutting wire 18 is difficult to occur. Incidentally, the first main guide pulleys 7*a*, 7*b* are preferably disposed in such a manner that the gap of the cutting wire 18 between the tension side and the loosening side becomes appropriately great.

When cutting is completed and the cutting wire 18 leaves the reinforced concrete structure 2, the cutting wire 18 is hooked up and held by one 7*a* of the first main guide pulleys. Therefore, dangerous lump of the cutting wire 18 does not occur.

In addition to the guide operation for the cutting wire 18 by the first main guide pulleys 7*a*, 7*b* and by the second main guide pulleys 8*a*, 8*b*, the auxiliary pulley 8*c* is disposed as described above and as shown in the drawing in the present invention. Accordingly, the cutting wire 18 from the guide pulley 13 on the loosening side to the one 8*a* of the second main guide pulleys is guided by the auxiliary guide pulley 8*c*. In consequence, two cutting wire extending from the pair of the second main guide pulleys to the wire driving device are separated from each other and do not come into mutual contact.

Particularly when the cut plane of the reinforced concrete structure is relatively close to the disposition plane of the wire driving device 15, two cutting wire 18 for cutting, which extend from both second main guide pulleys 8*a*, 8*b* to the wire driving device, come close to each other. Depending on the condition of the fixed surface of the first guide pulley bed 5 of the reinforced concrete structure as the matter to be cut, there is the case where the second main glide pulleys 8*a*, 8*b* cannot be disposed with a sufficient space between them. In such a case, too, the two cutting wires 18 extending from the second main oxide pulleys 8*a*, 8*b* to the wire driving device come close to each other. Particularly in this case, when the cutting wire 18 are guided by the opposed inside portions of both second main guide pulleys 8*a*, 8*b*, the cutting wire 18 come further close to each other.

However, because the auxiliary guide pulley 8*c* is disposed as described above, the cutting wire extending from both second main guide pulleys 8*a*, 8*b* to the wire driving devise can secure a space by at least the diameter of the auxiliary guide pulley 8*c*. Accordingly, it is possible to prevent mutual contact of both cutting wires, mutual collision and breakage of diamond beads or their entanglement which otherwise results in the breakage of the cutting wire.

Incidentally, the embodiment given above represents the example where the cutting wire to be wound on the pair of the first main guide pulleys are wound in such a fashion as to extend outside one of the first main guide pulleys and inside the other of the first main guide pulleys in order to prevent the cutting angle from attaining a sharp angle at the time of completion of cutting and to prevent the cutting wire from jumping when cutting is completed. To accomplish the operations described above, the cutting wire need be disposed in such a manner as to extend outside at least one of the first main guide pulleys. Needless to say, the cutting wire may be so wound as to extend outside both of the first main guide pulleys, for example.

Besides the embodiment described above, the present invention may be modified in various ways as shown in FIGS. 3 to 9, for example. In the embodiment shown in FIG. 3, a side guide pulley 20 is disposed in addition to the guide pulleys of the embodiment described above so that even when the pair of main guide pulleys are disposed close to one another, the bend of the cutting wire near the end of the cutting operation can be reduced. In this embodiment, too, the auxiliary guide pulley 8*c* can be disposed in the same way as in the embodiment shown in FIG. 2.

Figure 4:
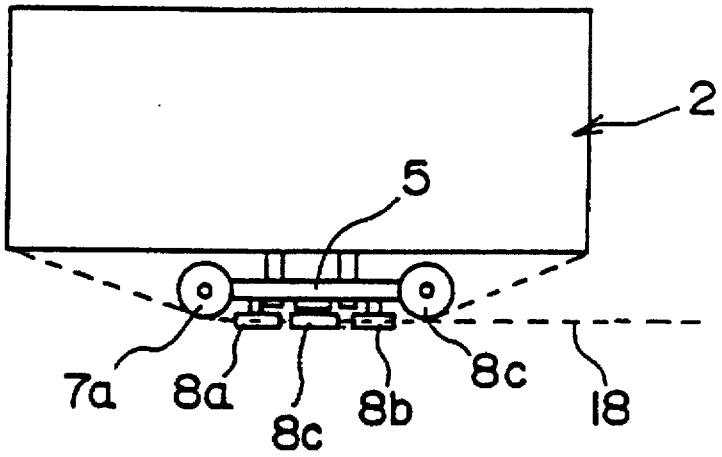
FIG. 4 is a plan view of still another embodiment of the present invention.

In the embodiment shown in FIG. 4, the second main guide pulleys 8*a*, 8*b* of the embodiment described above are disposed more inward than the first main guide pulleys 7*a*, 7*b*. At this time, the auxiliary guide pulley 8*c* is disposed in the same way as in the embodiment shown in FIG. 2.

In the embodiments shown in FIGS. 5 to 9, the cutting wire extending from the main guide pulleys to the wire cutting device are disposed perpendicularly to the side surface 2' on which the cutting wire are wound with respect to the reinforced concrete structure. Among them, in the embodiment shown in FIG. 5, side guide pulleys 20, 21 are disposed on both sides of the main guide pulleys 7*a*, 7*b*, 8*a*, 8*b*. In this embodiment, the auxiliary guide pulley 8*c* is disposed in such a manner as to separate the cutting wire, which extends from the second main guide pulleys 8*a*, 8*b* close to the matter to be cut to the wire driving device, from the other of the cutting wire. In this embodiment, the side guide pulley 21 functions as a guide after cutting proceeds.

Figure 5A:
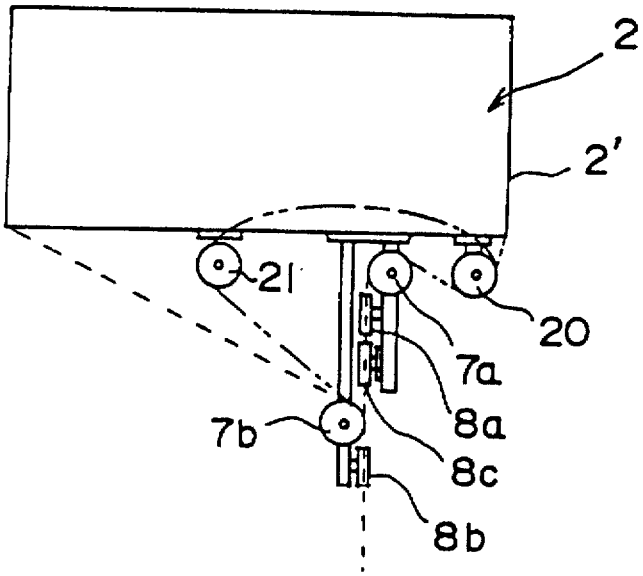
FIG. 5(*a*) is a plan view of still another embodiment of the present invention.
Figure 5B:
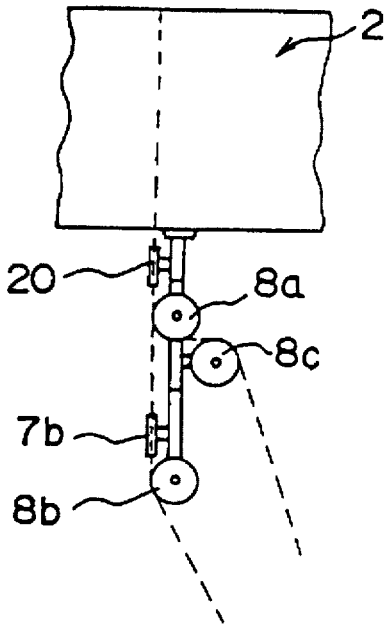
Figure 6:
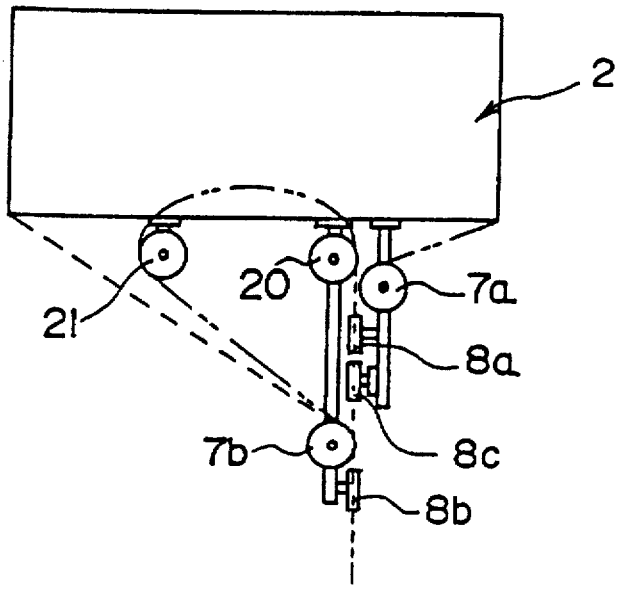
FIG. 6 is a plan view of still another embodiment of the present invention.

The embodiment shown in FIG. 6 disposes one of the side guide pulleys 20 closer to the other side guide pulley 21 with the main guide pulley as its center, in the embodiment shown in FIG. 5. In this embodiment, both side guides 20, 21 perform the guide operation after cutting proceeds. The auxiliary guide pulley 8*c* in this embodiment is disposed in the same way as in FIG. 5(*b*).

Figure 7:
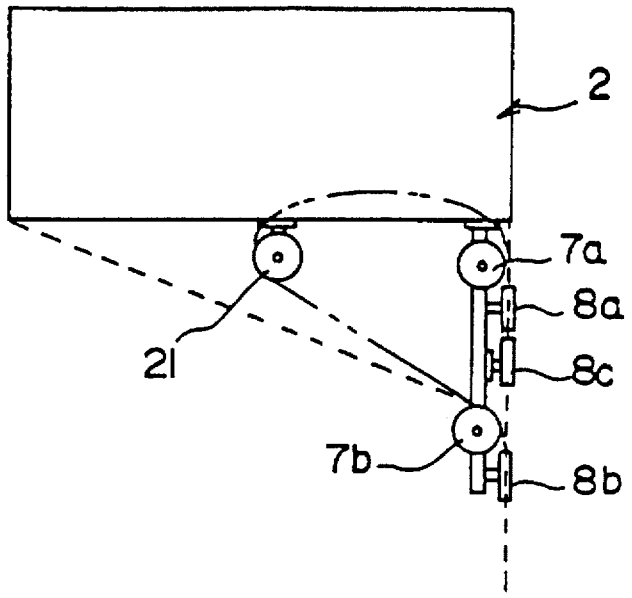
FIG. 7 is a plan view of still another embodiment of the present invention.

In the embodiment shown in FIG. 7, the first main guide pulley 7*b* is disposed in such a manner that its guide surface is positioned on the same plane as the side surface of the reinforced concrete structure 5, and only the side guide pulley 21 is disposed. In this way, one of the side guide pulleys can be omitted. In this embodiment, too, the auxiliary guide pulley 8*c* is disposed in the same way as in FIG. 5(*b*).

Figure 8:
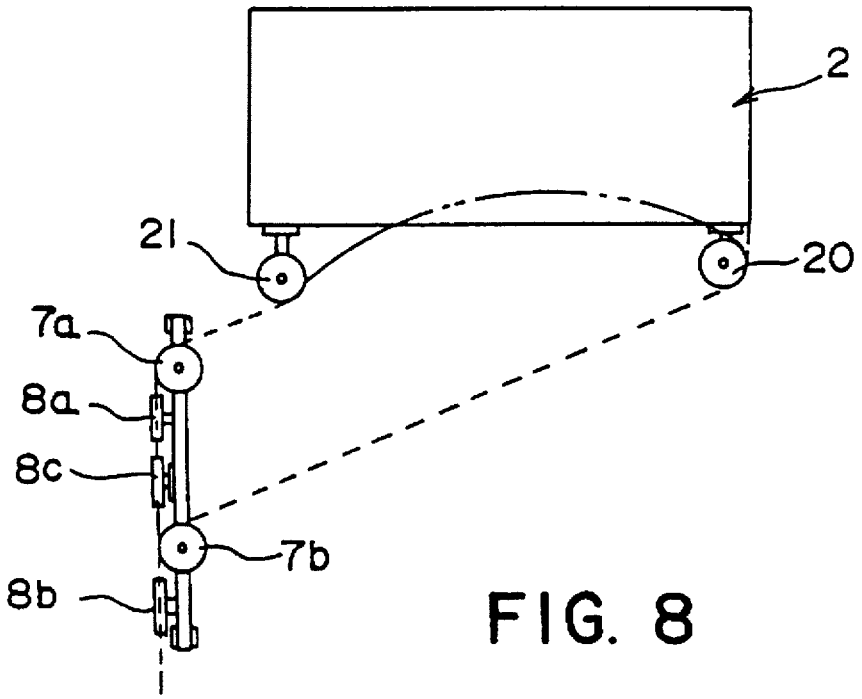
FIG. 8 is a plan view of still another embodiment of the present invention.

In the embodiment shown in FIG. 8, the main guide pulleys are disposed as a whole at positions spaced apart from the reinforced concrete structure 5, and only the side guide pulleys 20, 21 are disposed on the reinforced concrete structure. In this embodiment, too, the auxiliary guide pulley 8*c*, is disposed in the same way as in FIG. 5(*b*).

Figure 9A:
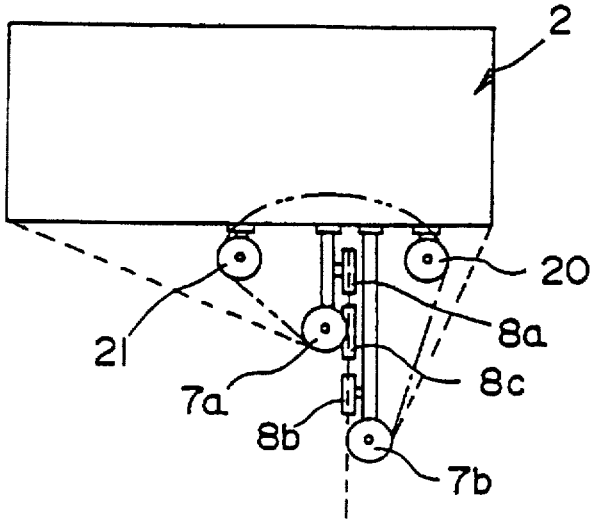
FIG. 9(*a*) is a plan view of still another embodiment of the invention.
Figure 9B:
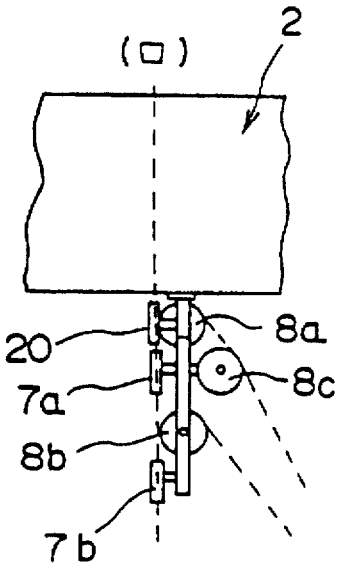

In the embodiment shown in FIG. 9, the main guide pulleys in the embodiments shown in FIGS. 5 to 8 are disposed in the opposite direction, and the side guide pulleys 20, 21 are disposed in the same way as in the embodiment shown in FIG. 5. Both side guide pulleys 20, 21 perform the guide operation after cutting proceeds. Incidentally, the auxiliary guide pulley 8*c* can be disposed in the same way as in FIG. 5(*b*).

When the main guide pulleys are disposed as in the embodiment shown in FIG. 9, the same arrangement can also be used in the embodiments shown in FIGS. 6 to 8. Furthermore, various embodiments such as horizontal cutting, vertical cutting, etc, can be arbitrarily selected by disposing the main guide pulleys at a suitable angle or by combining in various ways the side guide pulleys and other auxiliary guide pulleys.

Since the present invention has the construction described above and operates in the way as described above, the cutting wire guided by a pair of guide pulleys do not come into mutual contact and are not broken, and the reinforced concrete structure as the matter to be cut and guide pulleys and wire driving device can be safely disposed in various forms.

What is claimed is:

1. A wire sawing method of a reinforced concrete structure, comprising the steps of:

disposing a pair of main guide pulleys on the same plane as a scheduled cutting surface of a reinforced concrete structure;

guiding a cutting wire through said pair of main guide pulleys such that said cutting wire winds around said reinforced concrete structure along said scheduled cutting surface and makes a circulating path via a wire driving pulley of a wire driving device;

disposing an auxiliary guide pulley on a loosening side of said circulating path between said main guide pulleys and said wire driving pulley so as to widen said circulating path; and driving said cutting wire by said wire driving pulley under a regulated tension and at a regulated traveling speed.

2. The wire sawing method of a reinforced concrete structure according to claim 1, wherein a pair of said main guide pulleys comprise a first main guide pulley and a second main guide pulley, and said second main guide pulley commonly uses a tangent passing through a pulley groove of said first main guide pulley with said first main guide pulley and is disposed adjacent to said first main guide pulley.

3. The wire sawing method of a reinforced concrete structure according to claim 2, wherein a side guide pulley is disposed outside said first main guide pulley.

4. The wire sawing method of a reinforced concrete structure according to claim 2, wherein said second main guide pulley is disposed inside said first main guide pulley.

5. The wire sawing method of a reinforced concrete structure according to claim 1, wherein said cutting wire extending from said main guide pulleys to said wire driving device is disposed perpendicularly to the side surface of said reinforced concrete structure on which said cutting wire is to be wound.

6. The wire sawing method of a reinforced concrete structure according to claim 5, wherein side guide pulleys are disposed on both sides of said first main guide pulley.

7. The wire sawing method of a reinforced concrete structure according to claim 5, wherein both side guide pulleys are disposed on one of the sides of said first main guide pulley.

8. The wire sawing method of a reinforced concrete structure according to claim 2, wherein said first and second main guide pulleys are disposed in such a manner that their guide surfaces are positioned on the same plane as the side surface of said reinforced concrete structure, and side guide pulleys are disposed on one of the sides of said first and second main guide pulleys.

9. The wire sawing method of a reinforced concrete structure according to claim 2, wherein said first and second main guide pulleys are disposed on said reinforced concrete structure.

10. The wire sawing method of a reinforced concrete structure according to claim 2, wherein said second main guide pulley is disposed closer to said reinforced concrete structure than said first main guide pulley, and side guide pulleys are disposed on both sides of said first main guide pulleys.

11. In a wire sawing apparatus wherein a pair of main guide pulleys are disposed on the same plane as a scheduled cutting surface of a reinforced concrete structure along the surface of said reinforced concrete structure and a cutting wire is wound on said reinforced concrete structure from outside at least one of said main guide pulleys to make a circulating path, said cutting wire being driven by a wire driving pulley of a wire driving device under a regulated tension and at a regulated traveling speed, a guide pulley apparatus for wire sawing characterized in that an auxiliary guide pulley is disposed on a loosening side of said circulating path between said main guide pulleys and said wire driving pulley so as to widen said circulating path of said cutting wire guided by the pair of said main guide pulleys.

12. The guide pulley apparatus for wire sawing according to claim 11, wherein the pair of said main guide pulleys comprise a first main guide pulley and a second main guide pulley, and said second main guide pulley commonly uses a tangent passing through a pulley groove of said first main guide pulley with said first main guide pulley and is disposed adjacent to said first main guide pulley.

13. The guide pulley apparatus for wire sawing according to claim 12, wherein a side guide pulley is disposed outside said first main guide pulley.

14. The guide pulley apparatus for wire sawing according to claim 12, wherein said second main guide pulley is disposed inside said first main guide pulley.

15. The guide pulley apparatus for wire sawing according to claim 11, wherein said cutting wire extending from said main guide pulleys to said wire driving device is disposed perpendicularly to the side surface of said reinforced concrete structure on which said cutting wire is to be wound.

16. The guide pulley apparatus for wire sawing according to claim 15, wherein side guide pulleys are disposed on both sides of said first main guide pulley.

17. The guide pulley apparatus for wire sawing according to claim 15, wherein both side guide pulleys are disposed on one of the sides of said first main guide pulley.

18. The guide pulley apparatus for wire sawing according to claim 12, wherein said first and second main guide pulleys are disposed in such a manner that their guide surfaces are positioned on the same plane as the side surface of said reinforced concrete structure, and side guide pulleys are disposed on one of the sides of said first and second main guide pulleys.

19. The guide pulley apparatus for wire sawing according to claim 12, wherein said first and second main guide pulleys are disposed on said reinforced concrete structure.

20. The guide pulley apparatus for wire sawing according to claim 12, wherein said second main guide pulley is disposed closer to said reinforced concrete structure than said first main guide pulley, and side guide pulleys are disposed on both sides of said first main guide pulley.

* * * * *